US005088400A

United States Patent [19]

Ferguson

[11] Patent Number: 5,088,400

[45] Date of Patent: Feb. 18, 1992

[54] ADJUSTING PRESS PLATEN CLEARANCE

[75] Inventor: Andrew Ferguson, Bramalea, Canada

[73] Assignee: John T. Hepburn, Limited, Mississauga, Canada

[21] Appl. No.: 645,655

[22] Filed: Jan. 25, 1991

[51] Int. Cl.[5] ..... B30B 1/32; B30B 15/06

[52] U.S. Cl. ..... 100/257; 100/214; 100/269 R; 425/450.1

[58] Field of Search ..... 100/53, 214, 257, 269 R; 425/450.1

[56] References Cited

U.S. PATENT DOCUMENTS

| | | | |
|---|---|---|---|
| 3,606.638 | 9/1971 | Putkowski | 100/257 X |
| 3,855,920 | 12/1974 | Wright | 100/53 |
| 3,855,921 | 12/1974 | Wright | 100/53 |
| 3,862,596 | 1/1975 | Putkowski | 100/257 X |
| 4,759,k280 | 7/1988 | Malashenko | 100/257 |

*Primary Examiner*—Harvey C. Hornsby
*Assistant Examiner*—Stephen F. Gerrity
*Attorney, Agent, or Firm*—Mirek A. Waraksa

[57] ABSTRACT

In a press having a lower stationary platen, an upper movable platen, a hydraulic ram that travels with the upper platen, light-duty cylinders that position the upper platen, and a gate mechanism that closes above the ram to permit the ram to drive the upper platen during compression phases of operation, method and apparatus for adjusting the clearance between the upper and lower platens. A number of cylindrical spacers can be distributed, as desired, between an upper end of the ram and a spacer retaining mechanism located above the gate mechanism. The spacers are shaped to vertically interlock to form a stable stack atop the ram. The retaining mechanism extends downwardly from an upper cross-head of the press and is received in the interior of the stack of spacers. The retaining mechanism has spring-biased locking members that can locate below an internal lip of any spacer. To remove spacers, the ram is raised until all spacers seated on the ram interlock with any spacers supported by the retaining mechanism. All spacers are then raised until the locking members engage a lowermost one of the spacers to be removed. The ram is then simply lowered, retaining the a desired number of spacers. A similar procedure is followed to add one or more spacers, but a hydraulic cylinder is actuated to retract the locking members to release the spacers.

16 Claims, 4 Drawing Sheets

ADJUSTING PRESS PLATEN CLEARANCE

FIELD OF THE INVENTION

The invention relates to hydraulic presses, and more specifically, to adjustment of platen clearance in hydraulic presses in which a hydraulic cylinder travels with an upper movable platen and compresses a work piece between the platens when a gate mechanism above the hydraulic cylinder is closed.

BACKGROUND OF THE INVENTION

Reference is made to U.S. Pat. No. 4,759,280 to Malashenko which describes a hydraulic press having a stationary lower platen, a movable upper platen, and a number of long-stroke, light-duty hydraulic cylinders for general displacement and positioning of the upper platen. A short-stroke, large-bore hydraulic ram travels with the upper platen. A gate mechanism is closed above the ram just before compression phases of operation commence and the ram is then used to drive the upper platen downwardly. This arrangement has several advantages over more conventional presses in which a large central ram is attached both to the upper platen and to a cross-head of the press. These include reduced cycle time. Also, the stroke of the ram can be limited to considerably less than a meter, sufficient for compression phases of operation, thereby increasing the response time of the ram and permitting more precise control of the compression operation.

The prior patent also addresses the problem of adjusting the clearance between the upper and lower platens when the gate mechanism is closed. In molding applications, for example, the clearance may have to be adjusted to accommodate molds of different height. Increasing the stroke of the ram to accommodate a wide range of possible clearances is undesirable. The capacitance of the ram increases and its speed of response decreases. The prior patent teaches use of spacers stacked on the upper end of the ram to adjust platen clearance. Removing a spacer increases platen clearance; adding a spacer decreases platen clearance. In presses intended for compression molding of plastic products, such spacers may weigh several hundred kilograms and may be manipulated with a small hoist. This is acceptable in many installations, where molds are changed relatively infrequently. However, it would be desirable to simplify the handling of such spacers and particularly to reduce the time required to adjust platen clearance and change molds for production of alternative products.

SUMMARY OF THE INVENTION

In one aspect, in a hydraulic press comprising a frame including an upper frame portion, a stationary lower platen, a movable upper platen, a hydraulic cylinder aligned with a predetermined generally vertical axis, the hydraulic cylinder having a lower end portion attached to the movable platen and an upper end portion, means for displacing the hydraulic cylinder together with the movable platen along the vertical axis, and a gate mechanism located above the movable platen, the invention provides apparatus for adjusting the clearance between the upper and lower platens. The apparatus comprises at least one spacer shaped to seat in vertically releasable interlocking relationship on the upper end portion of the hydraulic cylinder and comprising locking structure shaped for horizontally releasable interlocking. Spacer retaining means are positioned to engage and disengage from the spacer when the spacer is located at a substantially predetermined vertical position above the gate mechanism. The retaining means comprise a support structure connected to the upper frame portion, displaceable locking means shaped to engage the locking structure of the spacer in horizontally interlocking relationship, and displacing means for displacing the locking means transversely relative to the axis, when the spacer is at the substantially predetermined vertical position, between a locking orientation in which the locking means interlock horizontally with the spacer to support the spacer against downward displacement and an unlocking orientation in which the locking means are clear of the spacer. Control means coupled to the displacing means permit control of the displacement of the locking means between the locking and unlocking orientations.

Various aspects of the invention will become apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
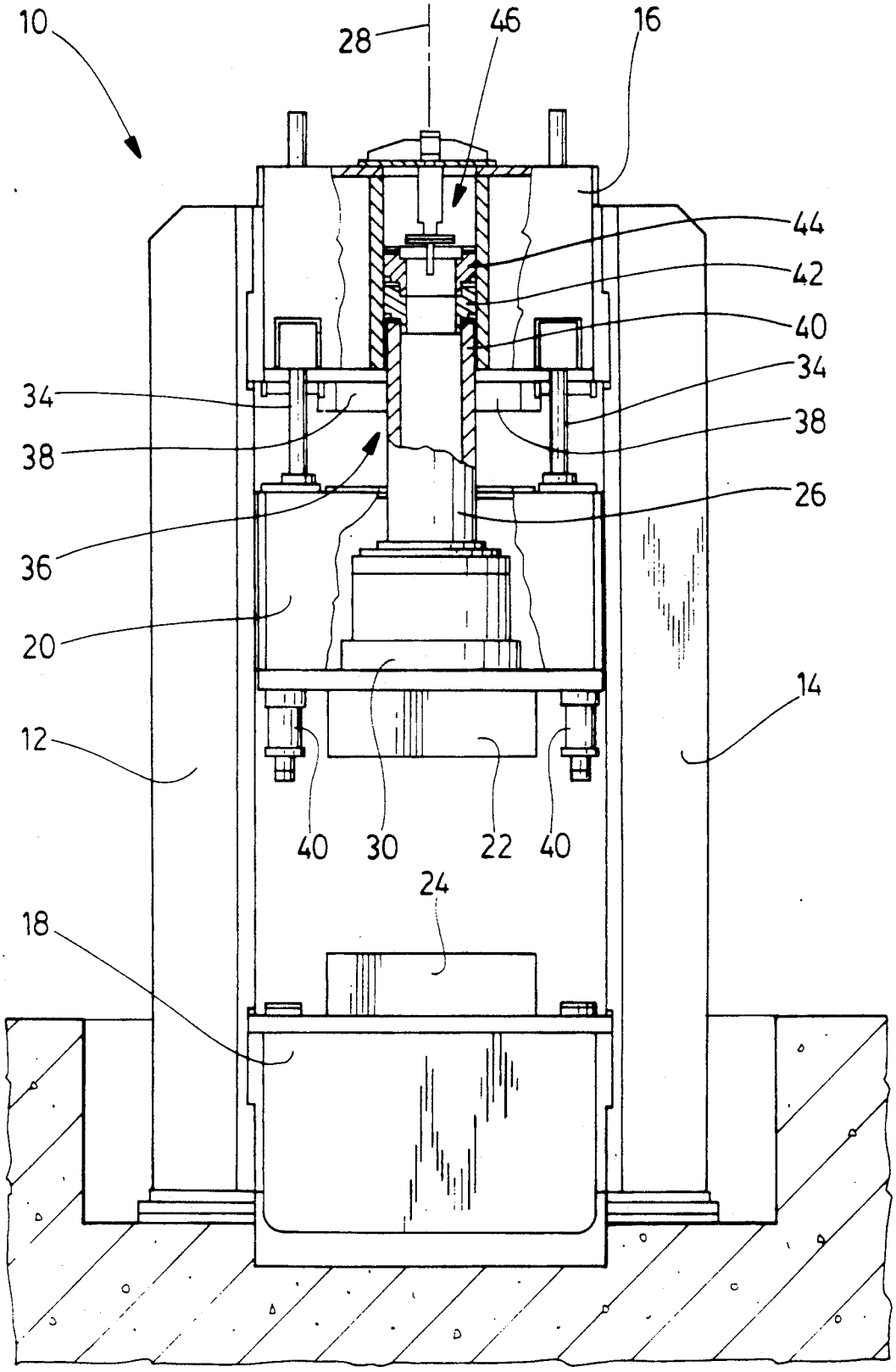
FIG. 1 is a fragmented elevational view of a press adapted according to the invention for adjustment of platen clearance.

Reference is made to FIG. 1 which illustrates a press 10 embodying the invention, a 2000-ton press intended for compression molding of plastic products. It comprises a conventional frame including side slabs 12, 14 and an upper cross-head 16. A lower stationary platen 18 is fixed to the frame. An upper movable platen 20 is located between the lower platen 18 and the cross-head 16. Upper and lower mold halves 22, 24 have been shown bolted to the platens 18, 20.

The upper platen 20 carries a central, large-bore ram 26 (hydraulic cylinder) that is used during compression phases of operation. The ram 26 is aligned with a vertical axis 28, has a lower end portion 30 attached to the movable platen 20, and an upper free end portion 32. Light-duty hydraulic cylinders 34 permit rapid positioning of the upper platen 20 relative to the lower platen 18. The light-duty hydraulic cylinders 34 would typically be used to position the upper platen 20 proximate to the lower platen 18 for compression of a molding charge between the mold halves 22, 24 and to retract the upper platen 20 sufficiently to permit removal of the molded product. The central ram 26 travels with the upper platen 20 during such gross positioning, being displaced in the process along the vertical axis 28. A central passage 29 formed in the cross-head 16 receives the upper end of the central ram 26 at upper extremes of platen travel.

A gate mechanism 36 is located above the movable upper platen 20. The gate mechanism 36 comprises two steel members 38 that are guided between an open orientation (FIG. 1) in which the central ram 26 moves freely along the vertical axis 28 and a closed orientation (not illustrated) obstructing upward movement of the ram 26. In the closed gate orientation, the ram 26 bears against the gate mechanism 36 to drive the upper platen 20 downwardly. Leveling cylinders 40 (only two of four such cylinders being illustrated in FIG. 1) control the descent of the upper platen 20 under the influence of the central ram 26 to maintain platen parallelism in a well known manner. The leveling cylinders 40 have been shown attached to the upper platen 20, but may be attached to the lower platen 18. Details of the construction and operation of such a press will be apparent from prior U.S. Pat. No. 4,759,280 to Malashenko, whose teachings are incorporated herein by reference, and will not be described further.

The press 10 incorporates apparatus for adjusting platen clearance. The apparatus comprises a pair of substantially identical steel spacers 42, 44 that are aligned during all phases of operation with the vertical axis 28. A retaining mechanism 46 is positioned to engage and disengage from either spacer when the spacer is raised on the upper end portion 32 of the ram 26 to a substantially predetermined vertical position, that retaining and releasing position being shown occupied by the lower spacer 42 in FIG. 2. As discussed more fully below, the retaining mechanism 46 can be used to remove one or both spacers 42, 44 from the upper end portion 32 of the ram 26 to increase platen clearance or to seat one or both spacers 42, 44 atop the ram 26 to decrease platen clearance.

The lower spacer 42 is generally cylindrical with a hollow interior. It is shaped to seat in vertically interlocking relationship with the upper end portion 32 of the ram 26. To that end, the lower spacer 42 has an annular vertically-oriented spigot 48 that extends from its lower end. The spigot 48 seats in a recessed surface 50 of complementary shape in the upper end portion 32 of the ram 26. This vertical interlocking resists horizontal tipping of the seated lower spacer 42, but permits the lower spacer 42 to be released from the upper end portion 32 of the ram 26 by relative vertical displacement. A wear ring 52 of hardened steel (bolted to the body of the ram 26) defines an uppermost horizontal surface of the ram 26 complementary to and supporting the lowermost annular surface 54 of the lower spacer 42. It will be noted that the lower spacer 42 comprises an upper, hardened-steel ring 57 which together with upper internal surfaces of the lower spacer 42 serve to receive the immediately suprajacent spacer 44 in similar vertically releasable interlocking relationship.

The lower spacer 42 is structured to be supported by the retaining mechanism 46. To that end, the lower spacer 42 has a internal lip 56 extending circumferentially around the interior of the spacer. Internal surface portions 58, 60, extending upwardly and downwardly from its lip 56, cooperate with the retaining mechanism 46 to deflect certain locking members 84, 86 to desired orientations during vertical displacement of the lower spacer 42 relative to the retaining mechanism 46. Such matters are discussed more fully below.

The upper spacer 44 is identical in configuration and dimensions to the lower spacer 42 in this embodiment of the invention. It comprises a similar spigot 62, internal circumferential lip 64, upper and lower internal surface portions 66, 68, and an upper, hardened-steel ring 70. The ring 70 and its upper internal surface portion 66 are shaped to seat another spacer (not illustrated) in vertically releasable interlocking relationship. Accordingly, additional spacers can be provided to permit further adjustment of platen clearance, and can be added above or below either of the two spacers 42, 44 shown.

The spacer retaining mechanism 46 will be described in greater detail with reference to FIGS. 2 and 3. The retaining mechanism 46 comprises a support structure including a cylindrical member 72 and a cross-plate 74 welded to the bottom of the cylindrical member 72. The cylindrical member 72 extends downwardly within the passage 29 of the cross-head 16 in general vertical alignment with the axis 28. It is secured to the cross-head 16 by a support member 76 welded to the top of the cylindrical member 72 and configured to seat substantially centred over the passage 29 and supported by the upper surface 78 of the cross-head 16. Machined inserts or shims 80, 82 may be used to ensure alignment with the axis 28.

The retaining mechanism 46 comprises a pair of plate-like locking members 84, 86. A guide 88 directs movement of the locking members 84, 86 radially relative to the vertical axis 28 between locking and unlocking orientations, shown respectively in FIGS. 2 and 3. The guide 88 comprises two narrow undercut plates 90, 92 which overlay opposing side edge portions of the locking members 84, 86 and which are bolted in parallel relationship on the cross-plate 74. A pair of parallel rectangular shafts 94, 96 are oriented generally with the vertical axis 28, centrally in the interior of the cylindrical member 72. The shafts 94, 96 are coupled to the locking members 84, 86 by a linkage comprising a generally triangular member 98 and a pair of double link arms 100, 102. The shafts 94, 96 can be displaced vertically by either a hydraulic cylinder 104 or a biasing spring 106 thereby to displace the locking members 84, 86.

The hydraulic cylinder 104 is mounted on the support member 76 and has a piston rod 108 extending downwardly along the axis 28 through the interior of the cylindrical member 72. A pivot pin 110 couples upper ends of the elongate shafts 94, 96 to the piston rod 108 and similar pin 112 couples the lower ends of the shafts 94, 96 to an upper corner of the triangular member 98. The link arms 100, 102 are connected by pivot pin 114, 116 (indicated in FIG. 3) to different ones of the two lower corners of the triangular member 98. The other ends of the link arms 100, 102 are connected by pivot pin 118, 120 (indicated in FIG. 3) to a different one of the two locking members 84, 86. Displacement of the two shafts 94, 96 downwardly along the axis 28 to the position in FIG. 2 displaces the locking members 84, 86 to the locking orientation. Displacement of the two shafts 94, 96 upwardly along the axis 28 to the position in FIG. 3 displaces the locking members 84, 86 contemporaneously to their unlocking orientation.

The locking members 84, 86 are normally urged to their locking orientation by the biasing spring 106. A shaft 122 is threaded into the bottom of the triangular member 98. The shaft 122 extends downwardly through the interior of a bushing 124 seated on the cross-plate 74 and through a central clearance hole in the cross-plate 74. A lower end 126 of the shaft 122 is threaded and carries a nut 128 that retains the coiled spring 106. The spring 106 acts between the cross-plate 74 and the nut 128 to draw the two shafts 94, 96 downwardly, in turn displacing the locking members 84, 86 to their locking orientation.

Figure 2:
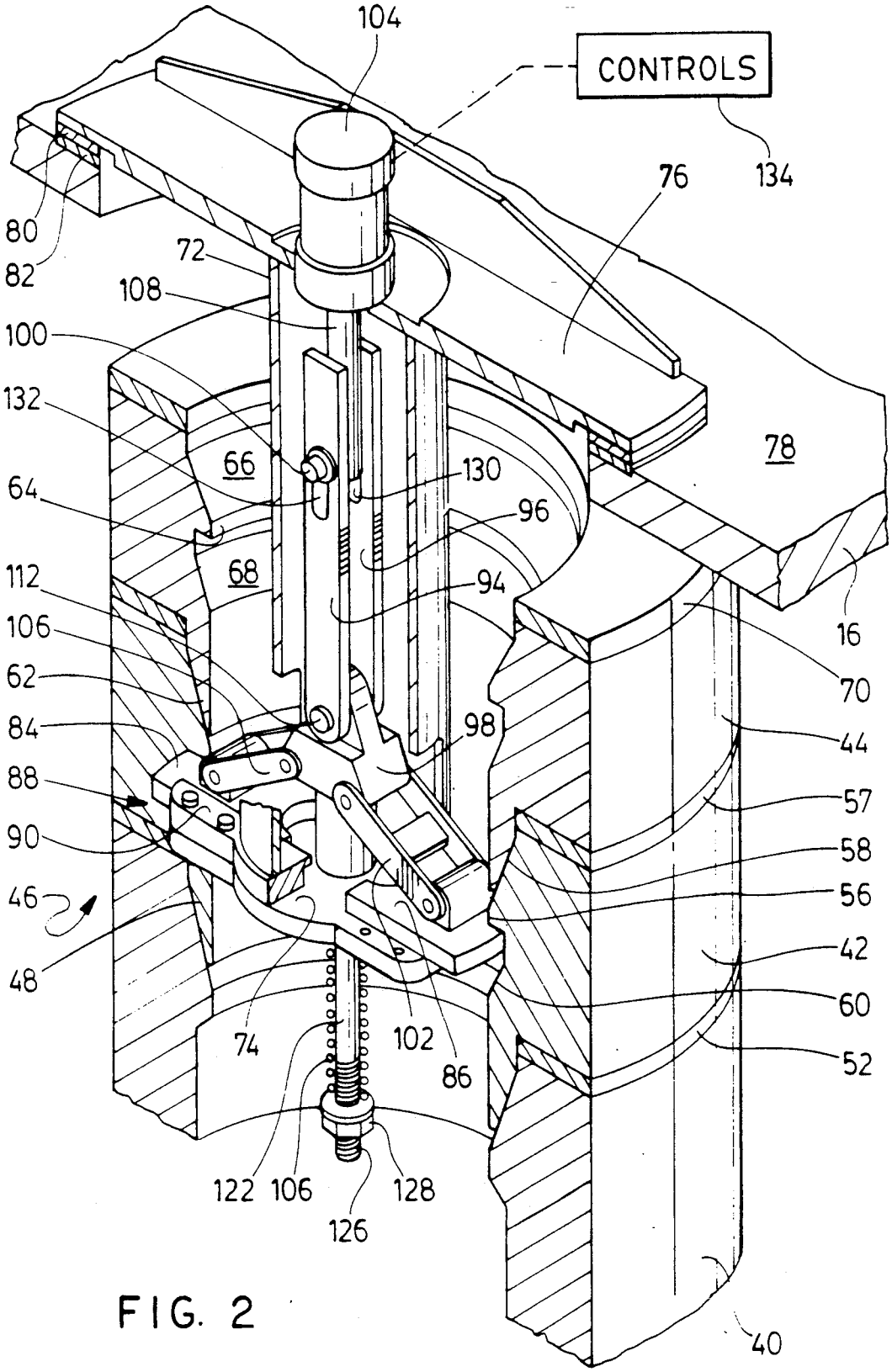
FIG. 2 is a perspective view in partial cross-section of a mechanism for retaining spacers, showing a pair of locking members in a locked orientation supporting a spacer and suprajacent spacer.
Figure 3:
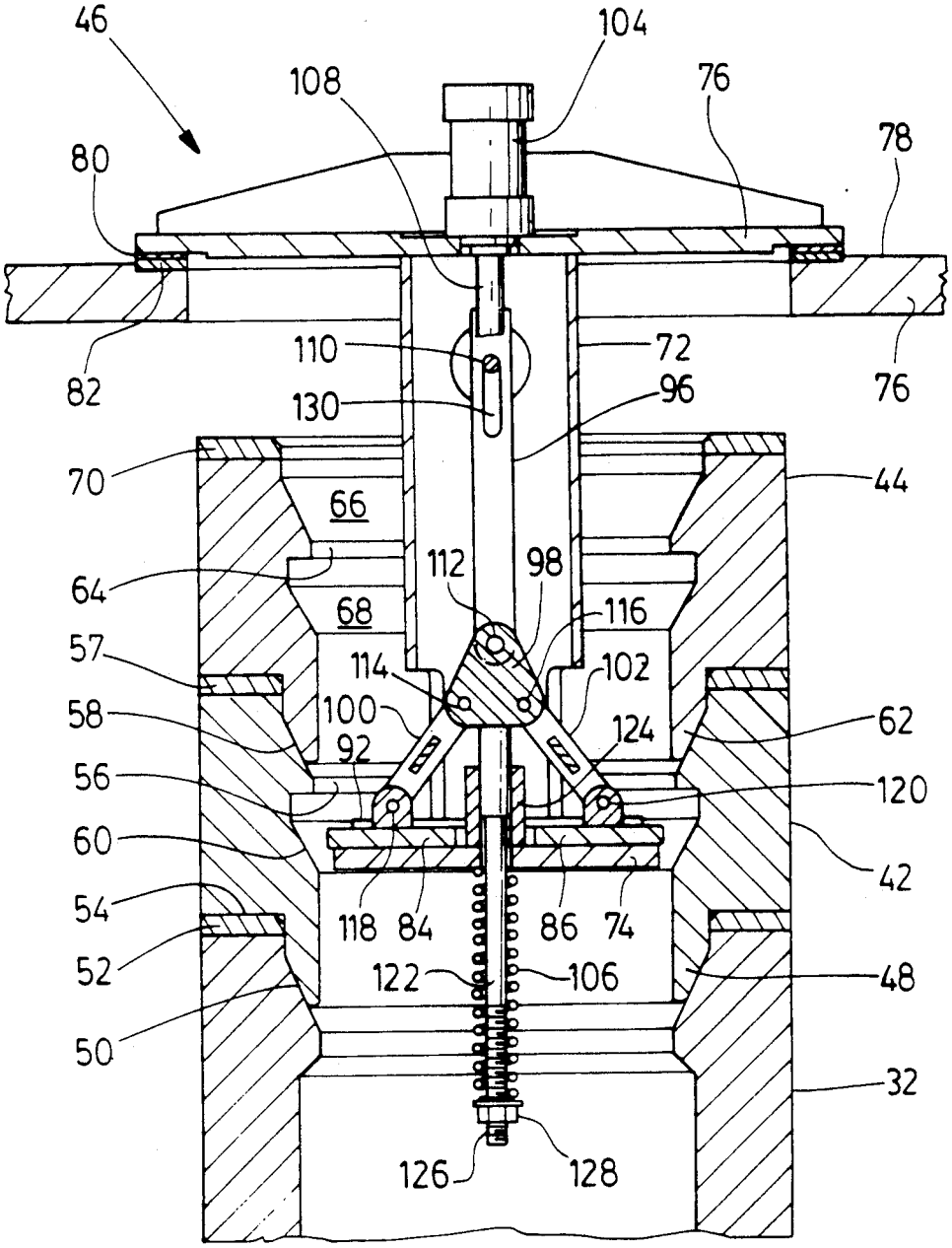
FIG. 3 is a cross-section in a vertical plane of the retaining mechanism with the locking member shown in an unlocking orientation clear of the spacers.

The hydraulic cylinder 104 is normally in a fully extended state, as in FIG. 2. When actuated, it contracts and draws the two shafts 94, 96 upwardly (overcoming the operation of the biasing spring 106). The linkage and guide 88 transform the vertical upper displacement of the shafts 94, 96 into a radially inward movement of the locking members 84, 86 toward the axis 28, as in FIG. 3, to their unlocking orientation. The hydraulic cylinder 104 may be extended to allow the locking members 84, 86 to return to their locking orientation under the influence of the biasing spring 106. It will be noted that the pin 110 coupling the two vertical shafts 94, 96 to the piston rod 108 can travel in vertical slots 130, 132 formed in the shafts 94, 96. This ensures that the locking members 84, 86 can be deflected toward their unlocking orientation in response to contact with certain surfaces of the spacers 42, 44 (overcoming the operation of the biasing spring 106). This arrangement avoids any need to contract the hydraulic cylinder 104 during such operations, allowing the biasing spring 106 and deflecting surfaces of the spacers 42, 44 alone to regulate the orientation of the locking members 84, 86. Controls 134 for actuation of the hydraulic cylinder 104 have only be diagrammatically indicated. Implementation of the controls 134 necessary to operate the hydraulic cylinder 104 thereby to control displacement of the locking members 84, 86 between locking and unlocking orientations will be readily apparent to those skilled in the art.

Figure 3A:
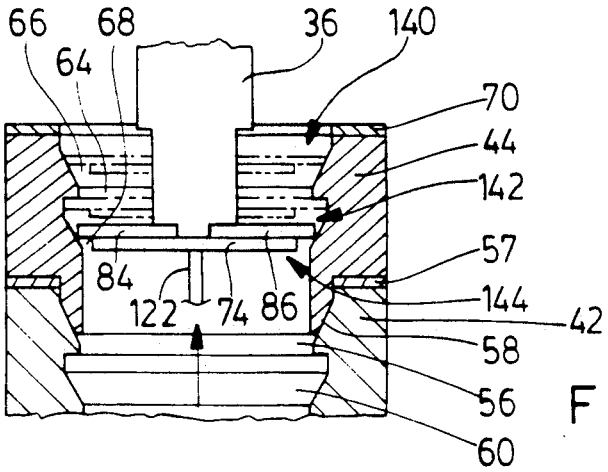
FIG. 3*a* is a diagrammatic cross-section in a vertical plane showing how upper and lower surfaces of the spacers deflect the locking members toward the unlocking orientation during travel over an internal lip and during transition to a subjacent spacer.

The significance of the upper and lower internal surface portions identified above will be discussed with reference to FIG. 3*a*. The drawing indicates various orientations that the locking members 84, 86 assume as the upper spacer 44 is raised relative to the locking members 84, 86. Initially, the upper internal surface portion 66 engages and deflects the locking members 84, 86 (as indicated in phantom outline at 140) toward their unlocking orientation for passage 29 over the lip 64. The biasing spring 106 thereafter urges the locking members 84, 86 to locate under the lip 64 in a locking orientation, as illustrated in solid outline at 142. As the spacer is raised further, its lower internal surface portion 68 deflects the locking members 84, 86 from the locking orientation beneath the lip 64 toward their unlocking orientation, as at 144. The uniform cylindrical shape of the lower internal surface portion 68 proximate to the bottom of the spacer ensures that the locking members 84, 86 are maintained in an deflected state until they disengage from the upper spacer 44 and engage the upper internal surface of the lower spacer 42. This ensures a proper transition from the spacers 44 to the immediately subjacent spacer 42 without requiring active intervention, as by appropriate actuation of the hydraulic cylinder 104. Although only two spacers 42, 44 have been illustrated, it will be appreciated that this basic operation will be repeated successively with any number of spacers seated in a vertical stack atop the ram 26. As the spacers so stacked are pushed successively past the predetermined vertical position in which the retaining mechanism 46 can engage each spacer, the locking members 84, 86 will be deflected radially inwardly to clear the lip of each spacer, will engage each spacer in the locking orientation with the locking members 84, 86 beneath its lip, and will be deflected radially inwardly for transition to any immediately subjacent spacer.

Figure 4A:
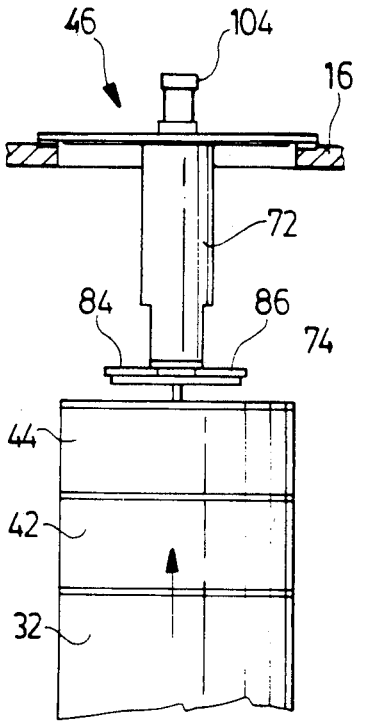
FIGS. 4*a*–4*c* show a sequence of steps for removing a spacer from the upper end of a hydraulic cylinder to increase platen clearance; and, FIGS. 5*a*–5*c* show a sequence of steps for adding a spacer to the upper end of the hydraulic cylinder to decrease platen clearance.
Figure 4B:
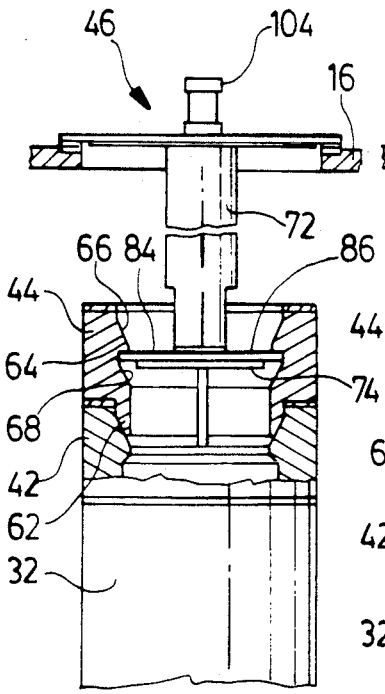
Figure 4C:
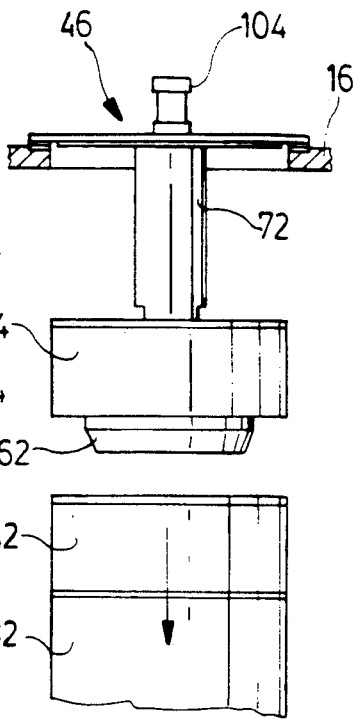

Reference is made to FIGS. 4*a*–4*c* that illustrate how a spacer can be removed from ram 26 to increase platen clearance. The gate mechanism 36 is of course in an open orientation during spacer removal (and also during spacer addition). The hydraulic cylinder 104 controlling the retaining mechanism 46 is fully-extended and inoperative throughout the process. The light-duty cylinders 34 are used to raise the upper platen 20 and the central ram 26. The spacers 42, 44, in a vertically interlocked stack on the upper end portion 32 of the ram 26, approach the locking members 84, 86, which are then in their locking orientation, as in FIG. 4*a*. The locking members 84, 86 are deflected by the upper internal surface portion 66 of the upper spacer 44 to pass over its lip 64 and are then displaced under the influence of the biasing spring 106 to their locking orientation under the lip 64 of the spacer, as in FIG. 4*b*. The upper platen 20 and ram 26 are then lowered, as in FIG. 4*c*, leaving the upper spacer 44 on the retaining mechanism 46. Platen clearance has been increased.

Figure 5A:
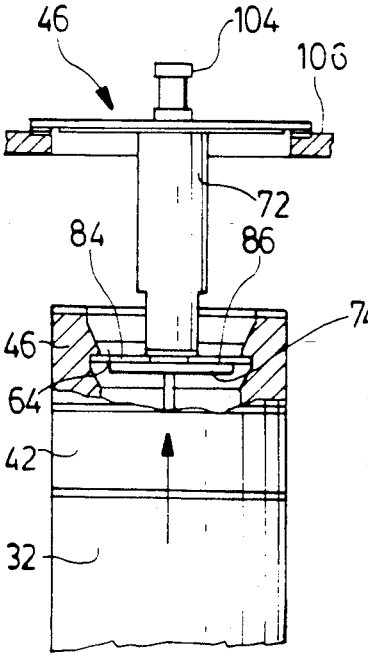
Figure 5B:
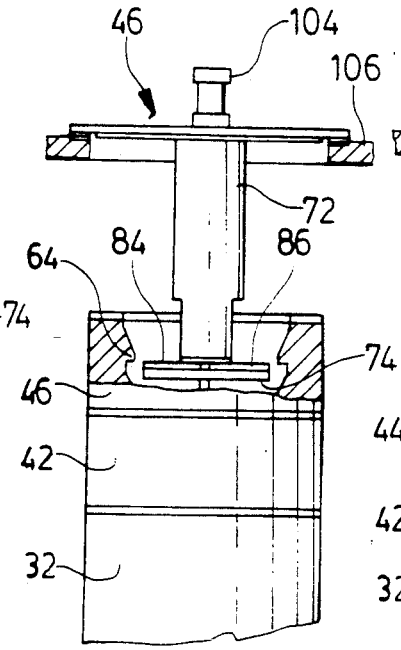
Figure 5C:
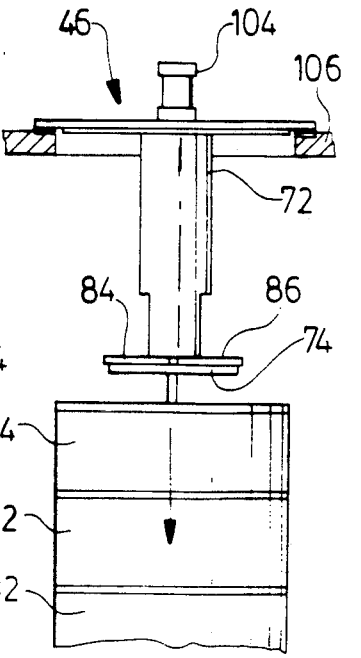

Reference is made to FIGS. 5*a*–5*c* that illustrate how a spacer can be added to the ram 26. The upper platen 20 and central ram 26 are raised until the single spacer engages and vertically interlocks with the hanging spacer, the weight of both spacers 42, 44 being borne by the ram 26 as in FIG. 5*a*. The hydraulic cylinder 104 is then actuated and contracted to displace the locking members 84, 86 from beneath the lip 64 of the upper spacer 44 to their unlocking orientation, clear of the upper spacer 44, as in FIG. 5*b*. While the hydraulic cylinder 104 remains actuated, the upper platen 20 and ram 26 are lowered, both spacers 42, 44 now being located atop the ram 26. Platen clearance has now been decreased.

Two spacers 42, 44 have been shown and discussed solely for purposes of illustrating the invention. The invention can be used with only a single spacer, assuming that only a single increment in platen clearance meets particular press requirements. It can also be operated with three or more spacers where several distinct increments in platen clearances are required to accommodate a wide range of mold heights. The spacers can be positioned atop the ram 26, between any spacers on the ram 26 and any spacers on the retaining mechanism 46, using a hoist or any other appropriate means. Fine adjustment of platen clearance may be achieved with appropriate electronic and hydraulic control of the length of the central ram 26. The ram 26 will normally have a stroke sufficient not only to accommodate required travel during compression phases of operation, but also to permit such fine adjustment.

A more general description of operation is as follows. During spacer removal or addition, regardless how the spacers are divided between the ram 26 and the retaining mechanism 46, all spacers are first oriented in a stable vertically interlocked stack. This is done by raising the ram 26 upwardly until any spacers seated on the ram 26 engage and vertically interlock with any spacers suspended by the retaining mechanism 46 (as, for example, in FIG. 5*b*). To remove spacers, the ram 26 is raised further pushing the spacers to be removed successively past the predetermined removal and releasing position until the lowermost one of the spacers to be removed arrives at the predetermined position. The upper and lower internal surface portions of the spacers deflect the locking members 84, 86 successively over the lips of the spacers to be removed, into locking orientations under the lip of each spacer to be removed, and radially inwardly for transition to subjacent spacers, until finally the lowermost of the spacers to be removed is engaged by the locking members 84, 86 in their locking orientation under its lip. This is done entirely under the influence of the biasing spring 106, the hydraulic cylinder 104 of the retaining mechanism 46 being inactive. The upper platen 20 and ram 26 are then simply lowered. Alternatively, to add spacers, the hydraulic cylinder 104 of the retaining mechanism 46 is contracted to disengage the locking members 84, 86 from any suspended spacers. The entire stack is lowered on the ram 26 until the spacer immediately above those to be added is at the predetermined spacer removal and releasing position (or until all spacers are below that position, assuming that all spacers are to be mounted atop the ram 26.) The hydraulic cylinder 104 of the retaining mechanism 46 is then restored to its extended state, the locking members 84, 86 then horizontally interlocking with the lowermost of the spacers to remain suspended on the retaining mechanism 46 (assuming less then all spacers are to be mounted atop the ram 26.) The upper platen 20 and ram 26 are then simply lowered. The retaining mechanism 46, specifically its locking members 84, 86, can be aligned with any particular spacer during such operations by visual sighting through the passage 29 in the cross-head 16 or by sensing with limit switches or other such devices.

Several features of the preferred embodiment should be noted. First, the biasing arrangement simplifies considerably the process of spacer removal. One need only raise the ram 26 until a lowermost one of the spacers to be removed is engaged by the retaining mechanism 46 and then lower the ram 26. Second, the risk of inadvertently dropping a spacer is largely eliminated. During both addition and removal of spacers, a vertically interlocked stack consisting of all spacers is formed, supported on the ram 26. If the biasing mechanism then fails or if the hydraulic cylinder 104 then remains, for some reason, in a fully contracted state, with locking members 84, 86 in their unlocking orientation, all spacers simply descend with the ram 26. As an additional precaution, controls may be provided that sense inward camming of the locking members 84, 86 and override contraction of the hydraulic cylinder 104 unless such camming is sensed. Accordingly, the hydraulic cylinder 104 would not be contracted to release a spacer and any overlieing spacers until the ram 26 supports all spacers as a single vertically interlocked stack. This would be necessary since the locking members 84, 86 could not be cammed inwardly until the spacer currently at the retaining and releasing position is raised thereby camming the locking members 84, 86 inwardly with its lower internal surface portion.

A number of variants are possible within the broader aspects of the invention. One immediate variant is to form a lip on the exterior of the required spacer or spacers and to mount the locking members outward of the vertical path through which the spacers are displaced. External upper and lower surface portions of the spacer or spacers can be shaped to cam the locking members radially outwardly so that the locking members can successively travel over the spacers, locking successively with each spacer in response to appropriate biasing means. One shortcoming of this arrangement is that the retaining mechanism is apt to be considerably larger and more cumbersome than the preferred embodiment described herein. "Horizontal interlocking" for purposes of the present invention involves the location of a locking means below a portion of a spacer for purposes of supporting the spacer. Horizontal interlocking can be achieved with a single locking member. For example, a passage may be extended horizontally through a spacer and a single elongate locking member may be passed through the passage. However, alignment of the retaining mechanism with the spacers is apt to become more critical and an analogous biasing arrangement would not appear possible. The horizontally releasable interlocking structures of the preferred embodiment comprises a lip and locking members shaped to locate under the lip. That lip need not be outwardly projecting. It can be constituted, for example, by an undercut, below a substantially cylindrical surface portion of each spacer. Other horizontally releasable interlocking arrangements can be used. For example, the locking members and spacers may be formed with cooperating wedge-like surfaces, an inclined surface of the locking members locating under a corresponding surface of a spacer. However, in such an arrangement, substantial forces must be applied continually to the locking members to support a spacer or a more complicated locking arrangement may be required in which the locking members are themselves locked into their locking orientation.

It will be appreciated that a particular embodiment of the invention has been illustrated, and that modifications, beyond those already described herein, may be made without departing from the spirit of the invention or necessarily departing from the scope of the appended claims.

I claim:

1. In a hydraulic press comprising a frame including an upper frame portion, a lower platen, a movable upper platen, a hydraulic cylinder aligned with a predetermined generally vertical axis, the hydraulic cylinder having a lower end portion attached to the movable platen and an upper end portion, means for displacing the hydraulic cylinder together with the movable platen along the vertical axis, and a gate mechanism located above the movable platen, the gate mechanism having an open orientation permitting upward movement of the upper end portion of the hydraulic cylinder along the axis and closed orientation obstructing upward movement of the upper end portion of the hydraulic cylinder along the axis, apparatus for adjusting vertical clearance occurring between the upper and lower platens when the gate mechanism is closed, comprising:

a spacer shaped to seat in vertically releasable interlocking relationship on the upper end portion of the hydraulic cylinder and comprising locking structure shaped for horizontally releasable interlocking;

spacer retaining means positioned to engage and disengage from the spacer when the spacer is located at a predetermined vertical position above the gate, the retaining means comprising:

(a) a support structure connected to the upper frame portion;

(b) displaceable locking means shaped to engage the locking structure of the spacer in horizontally interlocking relationship;

(c) displacing means connected to the support structure and to the displaceable locking means for displacing the locking means transversely relative to the axis, when the spacer is at the predetermined vertical position, between a locking orientation in which the locking means interlock horizontally with the spacer to support the spacer against downward displacement and an unlocking orientation in which the locking means are clear of the spacer; and, (d) control means coupled to the displacing means for controlling displacement of the locking means between the locking and unlocking orientations.

2. The apparatus of claim 1 in which the displaceable locking means comprise a plurality of displaceable locking members and the displacing means displace the locking members substantially contemporaneously between the locking and unlocking orientations.

3. The apparatus of claim 2 in which:

the displacing means comprise biasing means for urging the locking members to displace toward the locking orientation;

the spacer comprises a lip beneath which the locking members locate in the locking orientation to support the spacer and a surface portion extending upwardly from the lip, the surface portion being shaped to engage and deflect the locking members toward the unlocking orientation for passage over the lip in response to upward displacement of the spacer relative to the locking members thereby permitting the locking members to locate beneath the lip under the influence of the biasing means.

4. The apparatus of claim 2 in which:

the spacer is generally cylindrical with a hollow interior and comprises a circumferentially-directed lip within the hollow interior;

the support structure extends downwardly from the upper frame portion substantially along the vertical axis and is dimensioned to be received within the hollow interior of the spacer;

the displacing means comprise guide means attached to the support structure for directing movement of the locking members substantially radially relative to the axis between the locking and unlocking orientations, the locking members locating under the lip in the locking orientation thereby to support the spacer.

5. The apparatus of claim 4 in which:

the displacing means comprise biasing means for urging the locking members to displace toward the locking orientation; and, the spacer comprises an internal surface portion extending upwardly from the lip, the internal surface portion being shaped to engage and deflect the locking members toward the unlocking orientation for passage over the lip in response to upward displacement of the spacer relative to the locking members thereby permitting the locking members to locate under the lip under the influence of the biasing means.

6. The apparatus of claim 5 in which the displacing means comprise:

a vertically-oriented shaft;

means connected to the shaft for displacing the shaft vertically;

linkage means connecting the shaft to the plurality of locking members such that displacement of the shaft in a predetermined vertical direction displaces the plurality of locking members toward the locking orientation and displacement of the shaft in a vertical direction opposite to the predetermined vertical direction displaces the plurality of locking members toward the unlocking orientation; and, the biasing means comprise a spring acting oriented to urge the shaft to displace in the predetermined vertical direction.

7. In a hydraulic press comprising a frame including an upper frame portion, a lower platen, a movable upper platen, a hydraulic cylinder aligned with a predetermined generally vertical axis, the hydraulic cylinder having a lower end portion attached to the movable platen and an upper end portion, means for displacing the hydraulic cylinder together with the movable platen along the vertical axis, and a gate mechanism located above the movable platen, the gate mechanism having an open orientation permitting upward movement of the upper end portion of the hydraulic cylinder along the axis and closed orientation obstructing upward movement of the upper end portion of the hydraulic cylinder along the axis, apparatus for adjusting vertical clearance occurring between the upper and lower platens when the gate mechanism is closed, comprising:

a plurality of spacers aligned with the vertical axis, each suprajacent spacer of the plurality of spacers being shaped to seat in vertically releasable interlocking relationship on an immediately subjacent spacer of the plurality of spacers, a lowermost spacer of the plurality of spacers being shaped to seat in vertically releasable interlocking relationship on the upper end portion of the hydraulic cylinder, each of the plurality of spacers comprising locking structure shaped for horizontally releasable interlocking;

spacer retaining means positioned to engage and disengage from any one of the plurality of spacers located at a substantially predetermined vertical position above the gate, the spacer retaining means comprising:

(a) a support structure connected to the upper frame portion;

(b) displaceable locking means shaped to engage the locking structure of any one of the plurality of spacers located substantially at the predetermined vertical position in horizontally interlocking relationship;

(c) displacing means connected to the support structure and to the displaceable locking means for displacing the locking means transversely relative to the axis, when any one of the plurality of spacers is at the substantially predetermined vertical position, between a locking orientation in which the locking means interlock horizontally with the one spacer to support the one spacer and any of the plurality of spacers above the one spacer against downward displacement and an unlocking orientation in which the locking means are clear of the one spacer; and, (d) control means coupled to the displacing means for controlling displacement of the locking means between the locking and unlocking orientations.

8. The apparatus of claim 7 in which the displaceable locking means comprise a plurality of displaceable locking members and the displacing means displace the locking members substantially contemporaneously between the locking and unlocking orientations.

9. The apparatus of claim 8 in which:

the displacing means comprise biasing means for urging the locking members to displace toward the locking orientation; and, each of the plurality of spacers comprises a lip beneath which the locking members locate when supporting the spacer in the locking orientation;

the plurality of spacers comprise surfaces positioned and shaped to deflect the locking members toward the unlocking orientation for passage over the lips of any number of the plurality of spacers raised in succession past the substantially predetermined vertical position in vertically interlocked relationship on the upper end portion of the hydraulic cylinder thereby to locate the locking members under the influence of the biasing means successively beneath the lip of each of the number of the plurality of spacers so raised.

10. The apparatus of claim 8 in which:

the displacing means comprise biasing means for urging the locking members normally to displace toward the locking orientation; and, each of the plurality of spacers comprises a lip under which the locking members locate in the locking orientation relative to the spacer to support the spacer and an upper surface portion extending upwardly from the lip, the upper surface portion being shaped to engage and deflect the locking members toward the unlocking orientation for passage over the lip of the spacer in response to upward displacement of the spacer relative to the locking members thereby permitting the locking members to locate beneath the lip of the spacer under the influence of the biasing means.

11. The apparatus of claim 10 in which at least each suprajacent spacer comprises a lower surface portion extending downwardly from its lip, the lower surface portion being shaped to deflect the locking members, when oriented in the locking orientation beneath its lip, toward the unlocking orientation in response to upward vertical displacement of the suprajacent spacer relative to the locking members such that the locking members immediately engage the upper surface portion of the immediately subjacent spacer upon disengagement from the lower surface portion of the suprajacent spacer.

12. The apparatus of claim 8 in which:

each of the plurality of spacer is generally cylindrical with a hollow interior and comprises a circumferentially-directed lip within its interior;

the support structure extends downwardly from the upper frame portion substantially along the vertical axis and is dimensioned to be received within the hollow interior of each of the plurality of spacers;

the displacing means comprise guide means attached to the support structure for directing movement of the locking members outwardly relative to axis between the locking and unlocking orientations, the locking members locating beneath the lip of any one of the plurality of spacers when supporting the one spacer in the locked orientation.

13. The apparatus of claim 12 in which the displacing means comprise:

a vertically-oriented shaft;

means connected to the shaft for displacing the shaft vertically;

linkage means connecting the shaft to the plurality of locking members such that displacement of the shaft in a predetermined vertical direction displaces the plurality of locking members toward the locking orientation and displacement of the shaft in a vertical direction opposite to the predetermined vertical direction displaces the plurality of locking members toward the locking orientation;

a spring oriented to urge the shaft to displace in the predetermined vertical direction.

14. The apparatus of claim 12 in which:

the displacing means comprise biasing means for urging the locking members normally to displace toward the locking orientation; and, the plurality of spacers comprise surfaces positioned and shaped to deflect the locking members toward the unlocking orientation for passage over the lips of any number of the plurality of spacers raised in succession past the predetermined vertical position in vertically interlocked relationship on the upper end portion of the hydraulic cylinder thereby to locate the locking members under the influence of the biasing means successively below the lip of each of the number of the plurality of spacers so raised.

15. The apparatus of claim 12 in which:

the displacing means comprise biasing means for urging the locking members to displace toward the locking orientation; and, each of the plurality of spacers comprises an upper surface portion extending upwardly from its lip, the upper surface portion being shaped to engage and deflect the locking members toward the unlocking orientation for passage over the lip of the spacer in response to upward displacement of the spacer relative to the locking members thereby permitting the locking members to locate beneath the lip of the spacer under the influence of the biasing means.

16. The apparatus of claim 15 in which at least each suprajacent spacer comprises a lower surface portion extending downwardly from its lip, the lower surface portion being shaped to deflect the locking members, when oriented in the locking orientation beneath its lip, toward the unlocking orientation in response to upward vertical displacement of the suprajacent spacer relative to the locking members such that the locking members immediately engage the upper surface portion of the immediately subjacent spacer upon disengagement from the lower surface portion of the suprajacent spacer.

* * * * *